United States Patent [19]

Jackson

[11] Patent Number: 5,000,913

[45] Date of Patent: Mar. 19, 1991

[54] HAFNIUM CONTAINING HIGH TEMPERATURE NB-AL ALLOY

[75] Inventor: Melvin R. Jackson, Schenectady, N.Y.

[73] Assignee: General Electric Company, Schenectady, N.Y.

[21] Appl. No.: 279,640

[22] Filed: Dec. 5, 1988

[51] Int. Cl.[5] ..... C22C 27/02

[52] U.S. Cl. ..... 420/426; 420/425; 148/133

[58] Field of Search ..... 420/426, 425

[56] References Cited

U.S. PATENT DOCUMENTS 3,667,940 6/1972 McDonald ..... 420/426

FOREIGN PATENT DOCUMENTS 463735 9/1972 U.S.S.R. .

OTHER PUBLICATIONS

Yoda et al., Trans. Nat. Res. Inst. Metals, vol. 10(3) 1968, pp. 125–141.

*Primary Examiner*—Upendra Roy

*Attorney, Agent, or Firm*—Paul E. Rochford; James C. Davis, Jr.; James Magee, Jr.

[57] ABSTRACT

An alloy is provided having exceptional strength at very high temperatures of 1200° C. and higher. The alloy contains niobium, hafnium, and aluminum in the following atomic percentage ratios:

| Ingredient | Concentration Range From | To |
|---|---|---|
| niobium | balance essentially | |
| hafnium | 5 | 18 |
| aluminum | 5 | 22 |

7 Claims, 2 Drawing Sheets

HAFNIUM CONTAINING HIGH TEMPERATURE NB-AL ALLOY

CROSS REFERENCE TO RELATED APPLICATION

The subject application relates to application Serial No. 202,357, filed June 6, 1988. It also relates to application Ser. No. 280,085 filed Dec. 5, 1988; to application Ser. No. 279,639, filed Dec. 5, 1988; to application Ser. No. 290,399 filed Dec. 29, 1988; and to application Ser. No. 288,394 filed Dec. 22, 1988. The text of the related application is incorporated herein by reference.

BACKGROUND OF THE INVENTION

The present invention relates generally to alloys and to shaped articles formed for structural use at high temperatures. More particularly, it relates to an alloy having a niobium base and which contains hafnium and aluminum additives. By a niobium base is meant that the principal ingredient of the alloy is niobium.

There are a number of uses for metals which have high strength at high temperature. One particular attribute of the present invention is that it has, in addition to high strength at high temperature, a relatively lower density of the order of 7.8 to 8.8 grams per cubic centimeter (g/cc).

In the field of high temperature alloys and particularly alloys displaying high strength at high temperature, there are a number of concerns which determine the field applications which can be made of the alloys. One such concern is the compatibility of an alloy in relation to the environment in which it must be used. Where the environment is the atmosphere, this concern amounts to a concern with the oxidation or resistance to oxidation of the alloy.

Another such concern is the density of the alloy. One of the groups of alloys which is in common use in high temperature applications is the group of iron-base, nickel-base, and cobalt-base superalloys. The term "base", as used herein, indicates the primary ingredient of the alloy is iron, nickel, or cobalt, respectively. These superalloys have relatively high densities of the order of 8 to 9 g/cc. Efforts have been made to provide alloys having high strength at higher operating temperatures and significantly above those of the superalloys.

It has been observed that the mature metal candidates for use in this field of high strength at high temperature can be grouped and such a grouping is graphically illustrated in FIG. 1. Referring now to FIG. 1, the ordinate of the plot shown there is the density of the alloy and the abscissa is the maximum temperature at which the alloy provides useful structural properties for aircraft engine applications. The prior art alloys in this plot are discussed in descending order of density and use temperatures.

With reference to FIG. 1, the materials of highest density and highest use temperatures are those enclosed within an envelope marked as Nb-base and appearing in the upper right hand corner of the figure. Densities range from about 8.7 to about 9.7 grams per cubic centimeter and use temperatures range from less than 2200° F. to about 2600° F.

Referring again to FIG. 1, the group of prior art iron, nickel, and cobalt based superalloys are seen to have the next highest density and also a range of temperatures at which they can be used extending from about 500° F. to about 2200° F.

A next lower density group of prior art alloys are the titanium-base alloys. As is evident from the figure, these alloys have a significantly lower density than the superalloys but also have a significantly lower set of use temperatures ranging from about 200° F. to about 900° F.

The last and lowest density group of prior art alloys are the aluminum-base alloys. As is evident from the graph these alloys generally have significantly lower density. They also have relatively lower temperature range in which they can be used, because of their low melting points.

The usefulness of the titanium-base alloys extends over a temperature range which is generally higher than that of the aluminum-base alloys but lower than that of the superalloys. Within this temperature range, alloy changes occur due to a phase transformation from hexagonal to cubic crystal structure.

A novel additional set of alloys is illustrated in the figure as having densities about equal to those of the superalloys but with useful temperature ranges potentially extending beyond the superalloy temperature range. These ranges of temperature and density include those for the alloys such as are provided by the present invention and which are formed with a niobium base.

BRIEF STATEMENT OF THE INVENTION

It is, accordingly, one object of the present invention to provide an alloy system which has substantial strength at high temperature relative to its weight.

Another object is to reduce the weight of the niobium alloys presently used in higher temperature application.

Another object is to provide an alloy which can be employed where high strength is needed at high temperatures.

Other objects will be in part apparent and in part pointed out in the description which follows.

In one of its broader aspects, these and other objects of the present invention can be achieved by providing a niobium base alloy according to the following compositional ranges (in atomic percentages):

The phrase "balance essentially" as used herein is used to include, in addition to niobium in the balance of the alloy small amounts of impurities and incidental elements, which in character and/or amount do not adversely affect the advantageous aspects of the alloy.

BRIEF DESCRIPTION OF THE DRAWINGS

The description which follows will be understood with greater clarity with references made to the accompanying drawings in which.

DETAILED DESCRIPTION OF THE INVENTION

Figure 1:
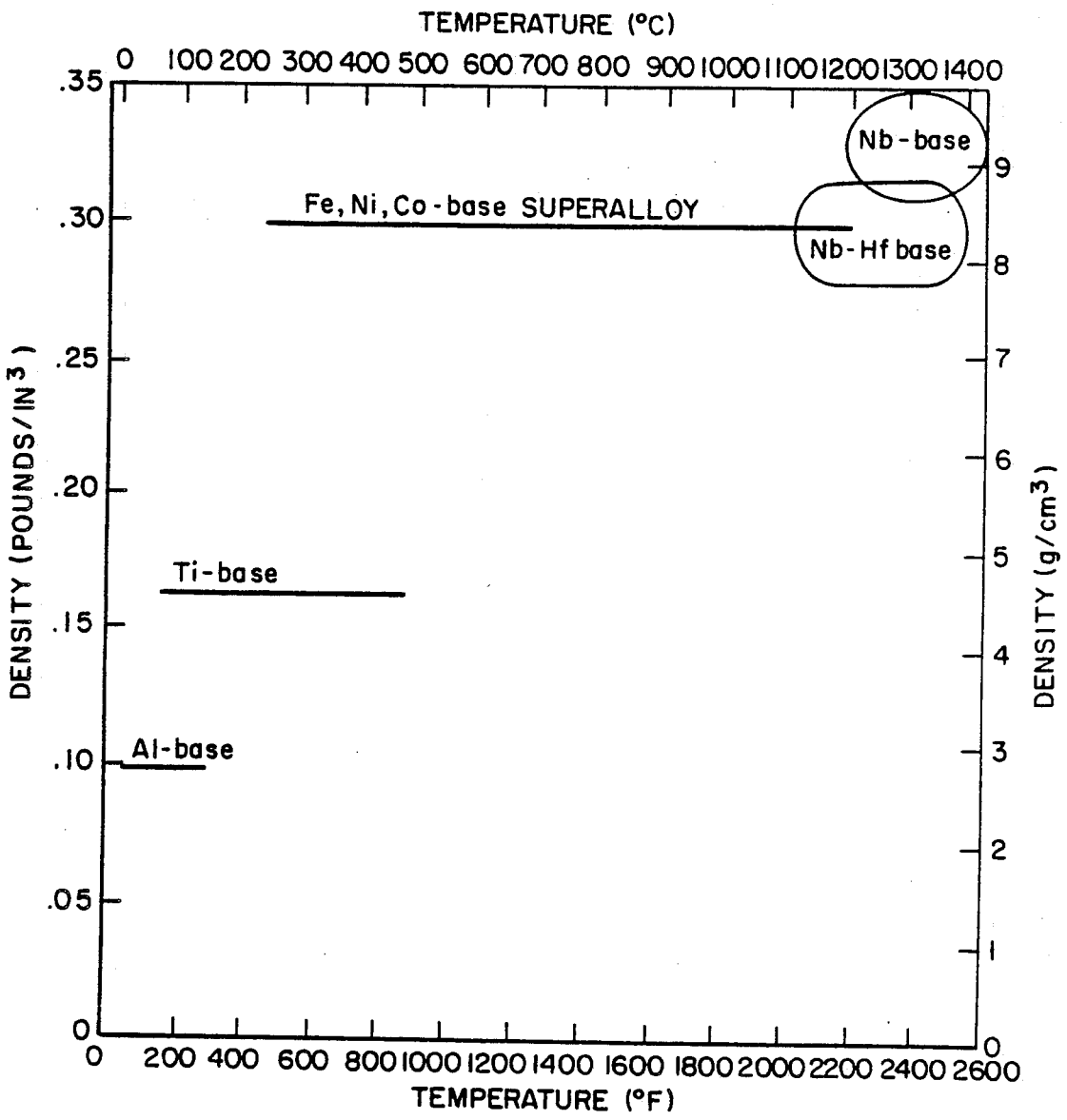
FIG. 1 is a graph in which the density of an alloy is plotted on the ordinate and the use temperature of the alloy is plotted on the abscissa.

With reference to FIG. 1 and with particular reference to the envelope labelled "Nb-Hf base", it is evident that the density of alloy provided by the present invention ranges from about 7.8 to about 8.8 grams per cubic centimeter. This density range corresponds essentially to that of the iron, nickel, or cobalt base superalloys.

However, as is also evident from the figure, the use temperature ranges from below 2000° F. to above 2500° F. This use range is above that for which the iron, nickel, and cobalt superalloys are suitable. The upper useful range of the superalloys is about from 500° F. to about 2200° F. The alloys of the subject invention extend this range upward by more than 300° F.

EXAMPLES 1 and 2

Two alloy samples were prepared. One had a density of 8.8 grams per cubic centimeter (g/cc) and the other had a density of 7.9 g/cc. The alloy composition of these samples is set forth in Table I immediately below.

TABLE I

| Ingredient | Ingredient Concentration in Atom % | | | |
|---|---|---|---|---|
| | Nb | Hf | Al | Density in g/cm$^3$ |
| Example 1 | 72 | 18 | 10 | 8.8 |
| Example 2 | 65 | 15 | 20 | 7.9 |

The alloy samples were prepared by conventional ingot forming means and conventional tensile test bars were prepared from the alloy samples. Tensile tests were conducted on the samples at 900° C. and at 1200° C. The results of these tests are tabulated in Table II, immediately below.

TABLE II

| Yield Strength | YS-900° C. | YS-1200° C. |
|---|---|---|
| Example 1 | 83 ksi | 42 ksi |
| Example 2 | 61 ksi | 45 ksi |

Figure 2:
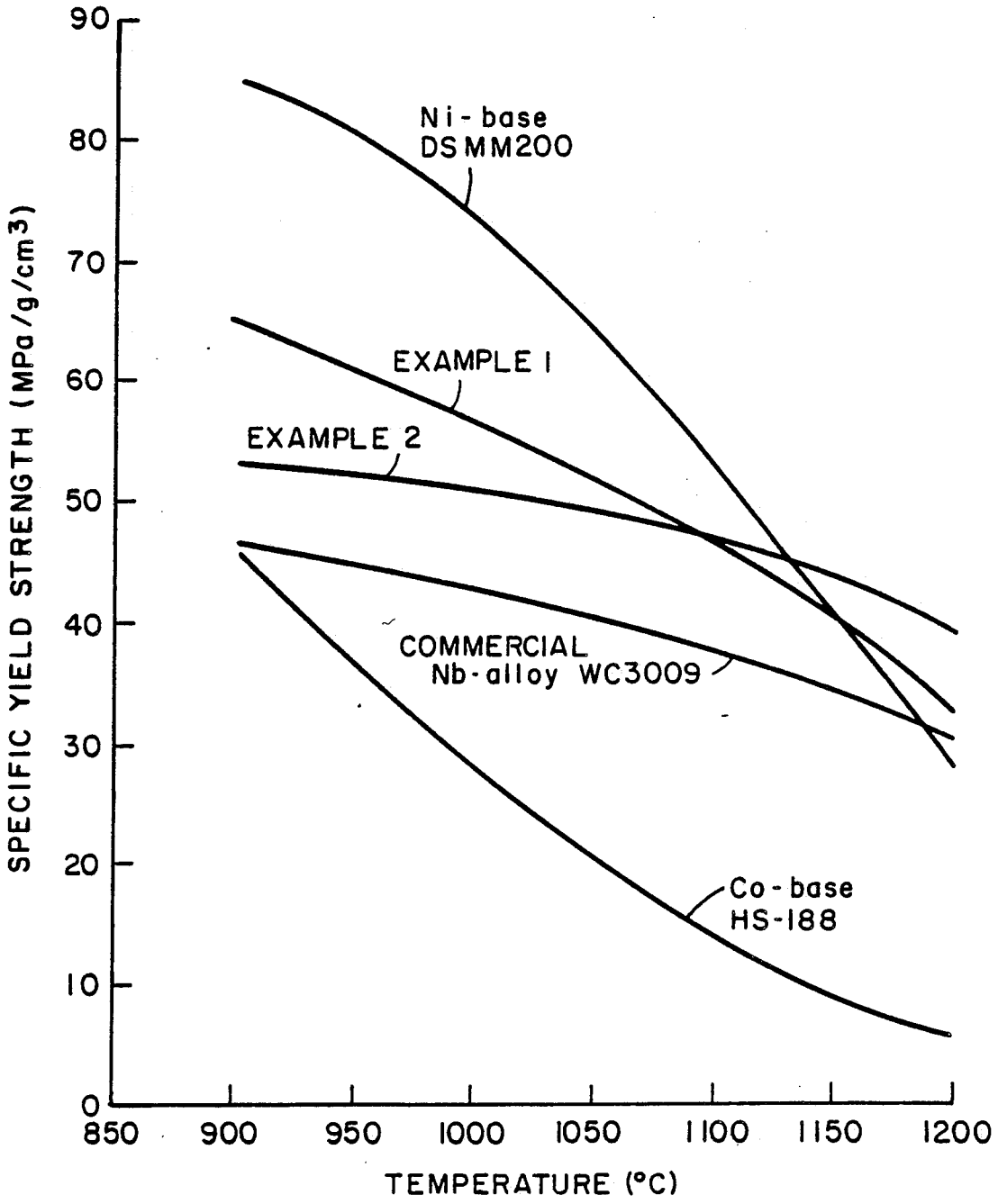
FIG. 2 is a graph in which the specific yield strength of alloys are plotted on the ordinate and the tensile test temperatures are plotted on the abscissa.

From the data plotted in Table II, it is evident that the alloys of this invention have remarkable strength at elevated temperatures. The strength at 1200° C. is two or three times greater, that is 200–300% greater than any other niobium alloy of such a low density. The specific strength (strength/density) is well above the value of any of the superalloys at the 1200° C. temperature. This is shown in FIG. 2, where data for examples 1 and 2 are compared against data for commercial Ni, Co and Nb-base alloys.

What is claimed and sought to be protected by Letters Patent of the United States is as follows:

1. An alloy consisting essentially of the following ingredients in atomic percentages:

| Ingredient | Concentration Range | |
|---|---|---|
| | From | To |
| Niobium | balance | essentially |
| Hafnium | 5 | 18 |
| Aluminum | 5 | 22 |

2. The alloy of claim 1, in which the alloy contains 5–11 hafnium, 5–14 aluminum, balance niobium.

3. The alloy of claim 1, in which the alloy contains 6–10 hafnium, 5–10 aluminum, balance niobium.

4. The alloy of claim 1 in which the hafnium concentration is between 5 and 11 atomic percent.

5. The alloy of claim 1 in which the hafnium concentration is between 6 and 10 atomic percent.

6. The alloy of claim 1 in which the aluminum concentration is between 5 and 14 atomic percent.

7. The alloy of claim 1 in which the aluminum concentration is between 5 and 10 atomic percent.

* * * * *